US005632166A

United States Patent [19]

Wiersma

[11] Patent Number: 5,632,166

[45] Date of Patent: May 27, 1997

[54] LINEAR LOCKING MECHANISM FOR FURNITURE

[75] Inventor: Timothy J. Wiersma, Kentwood, Mich.

[73] Assignee: Steelcase Inc, Grand Rapids, Mich.

[21] Appl. No.: 436,879

[22] Filed: May 8, 1995

[51] Int. Cl.[6] ..... E05B 63/14; E05C 9/00

[52] U.S. Cl. ..... 70/120; 70/118; 70/82; 292/337

[58] Field of Search ..... 70/120, 121, 117, 70/118, 119, 82, 83, 78; 292/337

[56] References Cited

U.S. PATENT DOCUMENTS

| | | | |
|---|---|---|---|
| 1,594,152 | 7/1926 | Chason | 70/82 |
| 1,736,306 | 11/1929 | Chason | 70/120 |
| 3,158,017 | 11/1964 | Guze | 70/119 |
| 3,857,620 | 12/1974 | Korell . | |
| 4,037,440 | 7/1977 | Shabtai et al. | 70/108 |
| 4,092,056 | 5/1978 | Signore et al. . | |
| 4,342,207 | 8/1982 | Holmes et al. | 70/119 |
| 4,362,034 | 12/1982 | Amgar | 70/108 |
| 4,445,729 | 5/1984 | Scheerhorn . | |
| 4,457,569 | 7/1984 | Scheerhorn . | |
| 4,534,192 | 8/1985 | Harshbarger et al. | 70/118 |
| 4,609,233 | 9/1986 | Walla | 312/219 |
| 5,267,460 | 12/1993 | Burleigh | 70/309 |
| 5,385,039 | 1/1995 | Feldpausch et al. . | |

FOREIGN PATENT DOCUMENTS

| | | | |
|---|---|---|---|
| 218316 | 3/1942 | Switzerland | 70/120 |
| 6832 | 5/1835 | United Kingdom | 70/118 |
| 11491 | 12/1846 | United Kingdom | 70/118 |

*Primary Examiner*—Steven N. Meyers
*Assistant Examiner*—Donald J. Lecher
*Attorney, Agent, or Firm*—Price, Heneveld, Cooper, Dewitt & Litton

[57] ABSTRACT

A locking mechanism for furniture unit is provided which utilizes a single component for translating rotary motion of a tumbler cylinder of a key lock into reciprocating, linear motion of a pair of opposing lock rods. The mechanism includes a base having a pair of linear guide channels which are defined by spaced sidewalls, a lock rod received in each of the linear guide channels, each of the lock rods having a radially extending projection engaging the sidewalls of one of the guide channels, a key lock, and an actuator which is attached to a drive shaft connected to the tumbler cylinder of the key lock. The actuator includes a pair of arcuate channels, each of which is at least partially defined by spaced camming surfaces which engage opposing sides of the projections on the lock rods, whereby rotation of the actuator in one direction retracts the rods to the unlocked position and rotation in the opposite direction extends the rods to the locked position. A lockable furniture unit employing a locking mechanism having a base, a pair of lock rods, a key lock, and an actuator which has arcuate camming surfaces which facilitate translation of rotary motion of the tumbler cylinder of the key lock into linear motion of the lock rods is also disclosed.

19 Claims, 3 Drawing Sheets

LINEAR LOCKING MECHANISM FOR FURNITURE

BACKGROUND OF THE INVENTION

This invention relates to a locking mechanism for furniture units such as desks, cabinets, credenzas, lockers, etc., and more particularly to a locking mechanism which is mounted to a closure member of a furniture unit and locks the closure member in the closed position by driving a pair of rods in opposite directions so that the ends thereof are received within apertures on opposing ends of the furniture unit.

Known locking mechanisms which utilize opposing, reciprocating lock bars have generally been relatively complicated devices having numerous moving and stationary parts, in addition to the lock rods and key lock. More specifically, known devices have generally employed a plurality of linkages, cables, cam shafts and/or other devices for translating rotary motion of a tumbler cylinder of a key lock into linear motion of the lock rods. In addition, such devices have often failed to achieve true linear motion of the lock rods which can result in jamming and/or rickety or jerky movement of the locking mechanism from the locked to the unlocked position. Known locking mechanisms using reciprocating lock bars have also frequently utilized key locks which must be rotated through a 180 degree angle from the locked to the unlocked position in order to achieve the desired linear displacement of the lock bars, thereby requiring additional effort than would be otherwise needed if a key lock which is rotated through a 90 degree angle from the locked to unlocked position could be used.

The foregoing characteristics of the known locking mechanisms which utilize opposing reciprocating lock bars to lock and unlock closure members on furniture result in numerous disadvantages. Such disadvantages include difficulty of assembly and mounting the locking mechanism on the closure member of the furniture unit, and the relatively high cost of the locking mechanism on account of the numerous parts of which known locking mechanisms are comprised. Other disadvantages with previous locking mechanisms having reciprocating lock bars is that they are often more difficult to operate, and tend to fail more frequently, than what might be considered acceptable.

SUMMARY OF THE INVENTION

The present invention overcomes the disadvantages of known locking mechanisms employing opposing, reciprocating lock bars, by utilizing a simpler, more reliable design which comprises fewer parts, and in particular utilizes only a single moving component to translate rotary movement of the key lock tumbler cylinder into linear movement of the lock rods.

The locking mechanism of the present invention generally comprises a base which is adapted to be mounted onto a furniture unit, a pair of lock rods, a key lock, and an actuator which translates rotary motion of the lock tumbler cylinder of the key lock into linear motion of the lock rods. The base includes a pair of linear guides channels having spaced sidewalls which engage a projection extending radially from the lock rod. The guide channels generally help limit motion of the lock rods to reciprocating linear motion. The actuator which is fixedly secured to a drive shaft connected to the tumbler cylinder of the key lock includes a pair of arcuate channels having spaced camming surfaces which engage opposing sides of the projections on the lock rods. Rotation of the actuator in one direction urges the rods toward the rotational axis of the tumbler cylinder to unlock a cabinet or other furniture unit, and counter-rotation of the actuator urges the rods away from the rotational axis of the tumbler cylinder into the locked position.

In accordance with the preferred aspect of the invention, the linear guide channels are longitudinally aligned so that the lock rods can be in line with one another. In another preferred aspect of the invention, guide walls extend radially outwardly from the base to further guide the lock rods for linear motion between the locked and unlocked positions.

In another preferred aspect of the invention, the base includes a plurality of cantilever springs having stop elements disposed thereon, and the actuator includes at least one projection which is engaged by one of the springs, and a stop element disposed thereon to maintain the lock in an unlocked or locked position when the tumbler is fully rotated to the unlocked or locked position respectively.

In accordance with a still further aspect of the invention, a lockable furniture unit is provided, which comprises a plurality of stationary wall panels and at least one closure member which together define a storage enclosure, and an improved locking mechanism employing a pair of opposing reciprocating lock bars, a key lock, and a one-piece actuator which translates rotary motion of the tumbler cylinder of the key lock into reciprocating, linear motion of the lock rods to lock the closure member in the closed position.

These and other features, objects, and benefits of the invention will be recognized by those who practice the invention and by those skilled in the art, from the specification, the claims, and the drawing figures.

DESCRIPTION OF THE PREFERRED EMBODIMENTS

Figure 1:
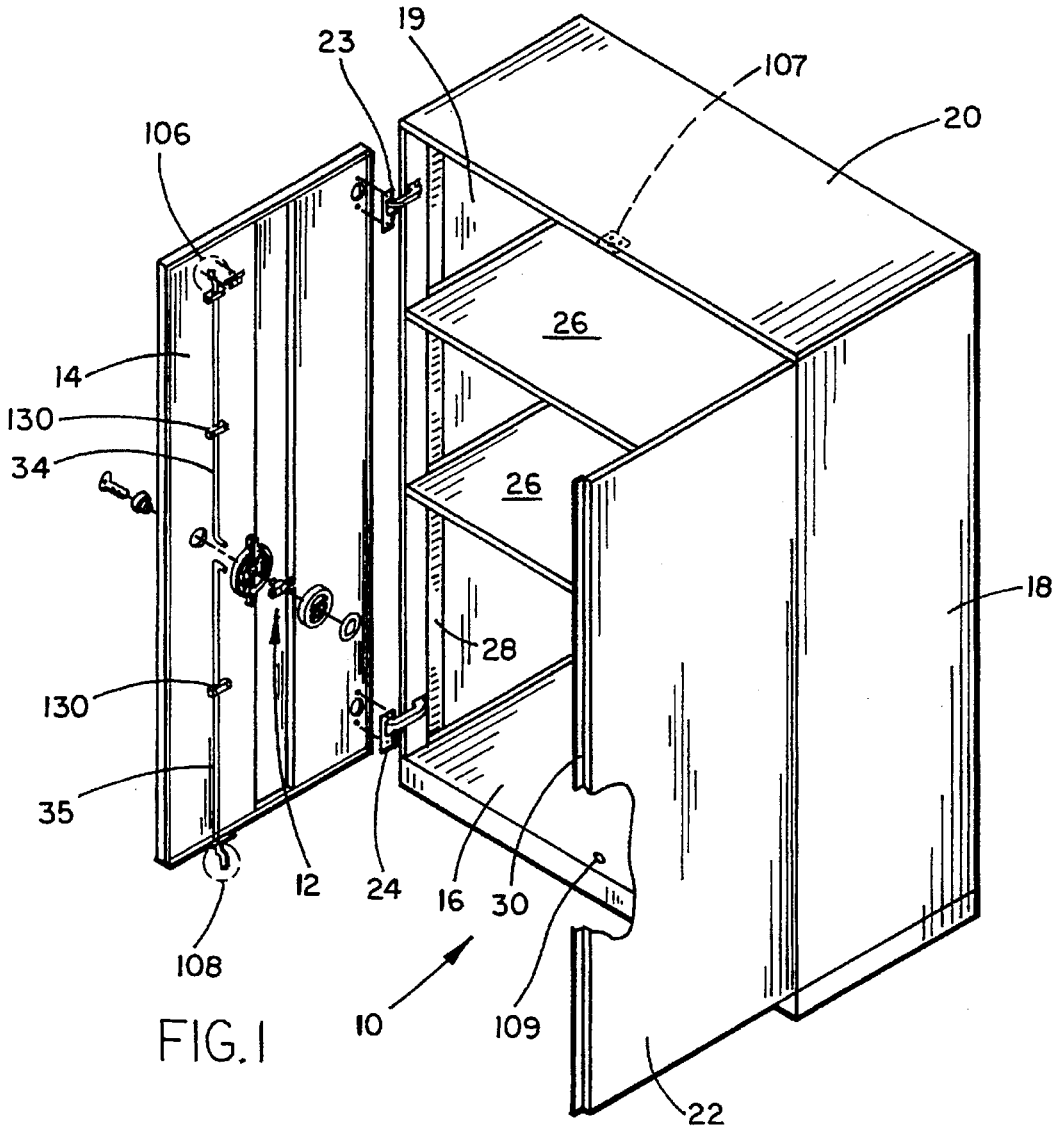
FIG. 1 is a front perspective view of a cabinet having vertically hinged doors and a locking mechanism in accordance with a preferred embodiment of the invention mounted thereto.

Shown in FIG. 1 is a cabinet 10 having a locking mechanism 12 which embodies the principles of the invention. The locking mechanism 12 is mounted to an interior wall of a door or closure 14. In the illustrated embodiment, the cabinet on which locking mechanism 12 is mounted includes a base 16, opposing side panels 18 and 19, a top panel 20 and a pair of doors 14 and 22. Door 14 is secured to a forward interior surface of sidewall 19 by way of conventional upper 23 and lower hinge 24 to allow door 14 to swing open about a vertical axis at a front corner of cabinet 10. Likewise door 22 is secured to a forward interior surface of sidewall 18 by way of upper and lower hinges (not shown) to allow door 22 to swing open about a vertical axis at the other front corner of cabinet 10. The cabinet also includes a back panel (not shown) and a plurality of shelves 26 resting on brackets (not shown) mounted in a conventional manner on slotted strips 28. Door 22 includes a vertical flange 30 extending from the edge distal from the edge on which the hinges are attached. To close cabinet 10, door 22 is first swung into the closed position and then door 14 is closed with its distal edge overlapping flange 30, so that a single locking mechanism 12 will retain both doors 14, 22 in the locked position. It will be appreciated by those skilled in the art that locking mechanism 12 can be utilized in a variety of furniture having a closure member such as a drawer, sliding door, vertically hinged door or horizontally hinged door. For example, in addition to cabinets, locking mechanism 12 can be used on desks, credenzas, file cabinets, lockers, and the like.

Figure 2:
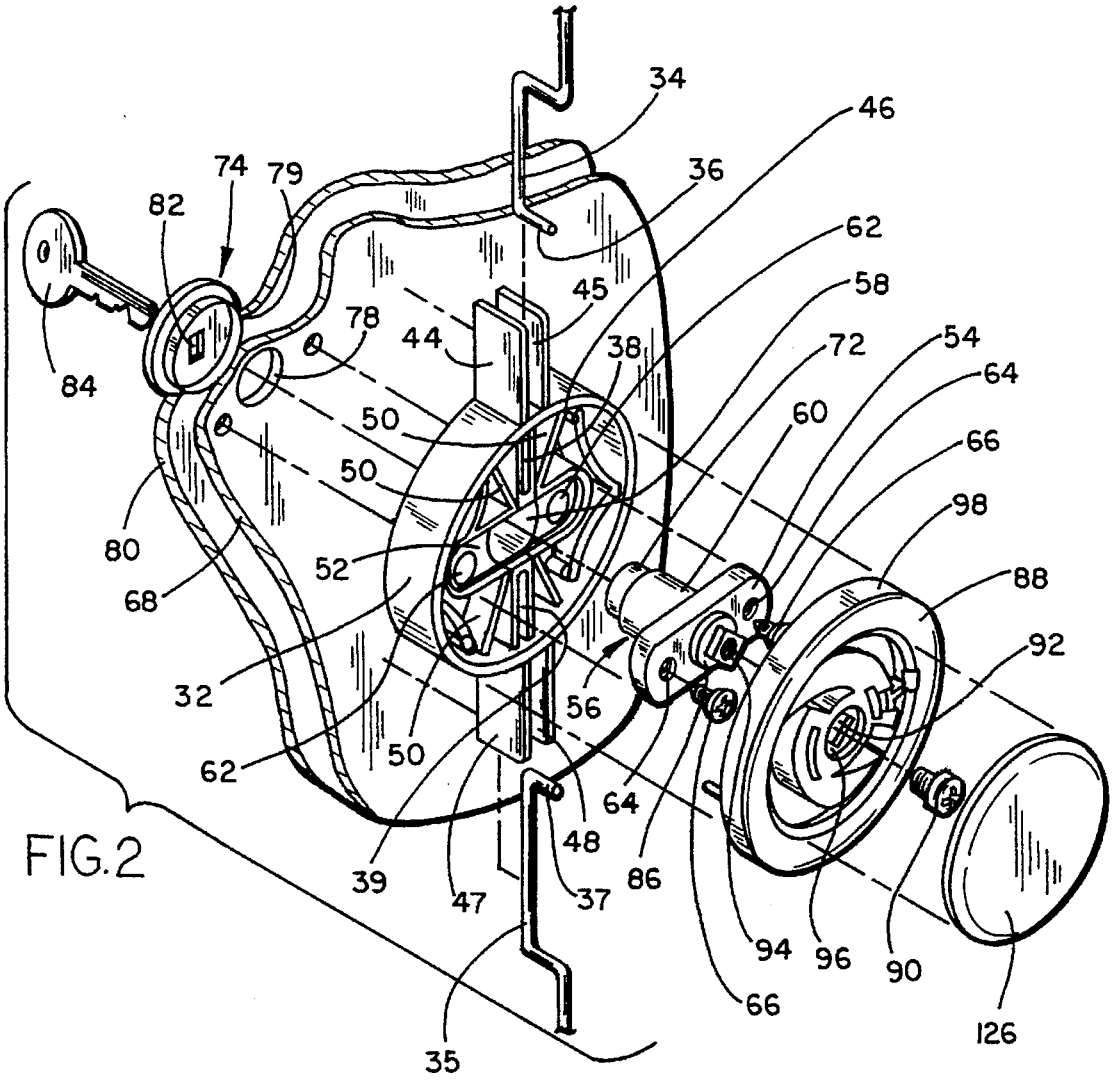
FIG. 2 is an enlarged exploded perspective view showing the various components of the locking mechanism.

As best illustrated in FIG. 2, the locking mechanism includes a base 32 which is adapted to be mounted onto an interior wall of a cabinet door or other interior surface of an office furniture unit, and a pair of reciprocating lock rods 34, 35. Each lock rod 34, 35 has a projection 36, 37, respectively, which extends radially from the main longitudinal axis, at a proximal end thereof. The proximal ends of lock rods 34,35 are each slidingly received within one of a pair of longitudinally aligned linear guide channels 38, 39, respectively, in base 32. Oppositely facing, parallel sidewalls 40, 41 and 42, 43 (FIG. 3) of guide channels 38, 39, respectively, are spaced to engage opposite sides of lock rods 34, 35, respectively, and projections 36, 37, respectively, to maintain linear tracking of the lock rods along the axis thereof during movement of the rods from the extended or locked position shown in FIG. 3 to the retracted or unlocked position shown in FIG. 4.

The illustrated base is generally cylindrical in shape and includes a pair of guide walls 44, 45 which extend radially outwardly from a curved perimeter wall 46. Guide walls 44, 45 are parallel and in line with sidewalls 40, 41 to help guide rod 34 for linear motion between the locked and unlocked positions. Likewise, a pair of guide walls 47, 48 extend radially outwardly from curved perimeter wall 46, and are parallel and in line with sidewalls 42, 43 to help guide rod 35 for linear motion between the locked and unlocked positions.

Figure 6:
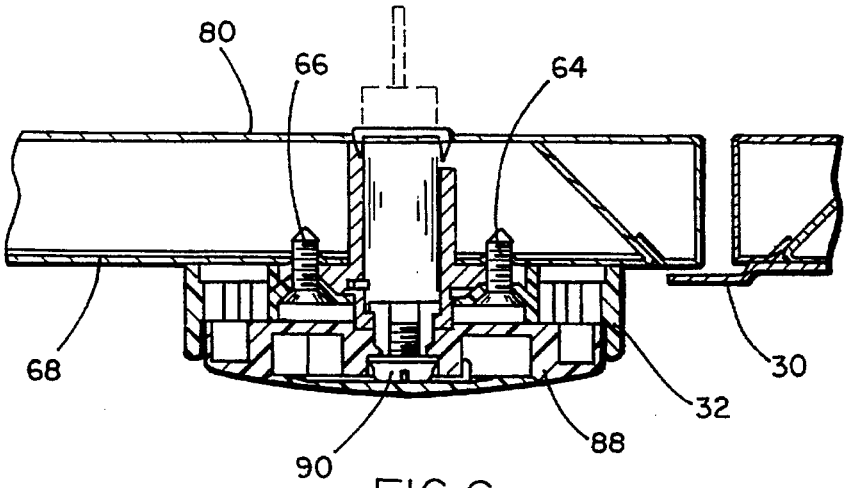
FIG. 6 is a top-sectional view of the locking mechanism mounted to a wall of a furniture unit.
Figure 5:
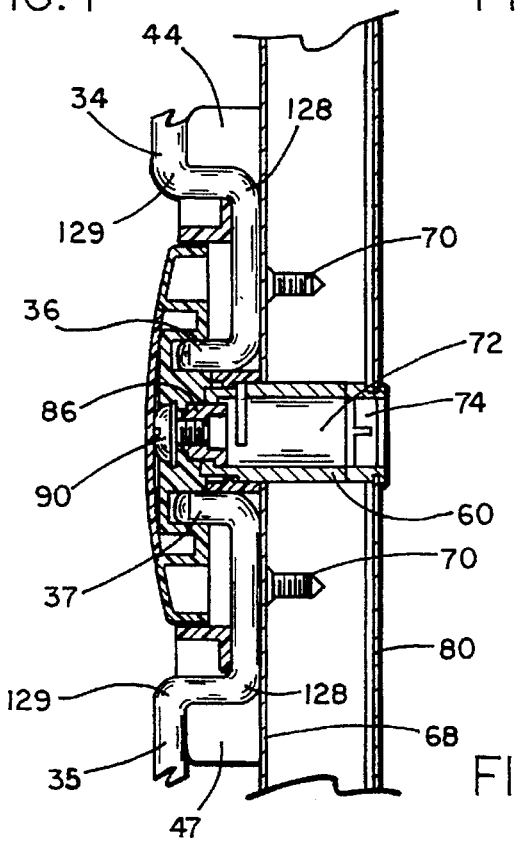
FIG. 5 is a side-sectional view of the locking mechanism mounted on a wall of a furniture unit.

Base 32 is preferably made from a thermoplastic material such as polypropylene and is formed by a suitable molding process such as injection molding. The base 32 is preferably formed with integral stiffening members 50, which provide strength and rigidity. The base 32 is also formed with an oblong recessed area 52 adapted to receive an apertured flange 54 of a conventional key lock 56. A central bore 58 through base 32 is adapted to receive the barrel 60 of key lock 56 and a pair of apertures 62 on opposite sides of central bore 58 extend from the recessed area 52 through the base 32. Apertures 62 are positioned for alignment with apertures 64 through flange 54. Fasteners 66 pass through apertures 64 and 62 and through an interior wall 68 of the office furniture unit to secure the key lock 56 and base 32 to wall 68 (as best illustrated in FIG. 6). The base can be provided with additional apertures for fasteners 70 (shown in FIG. 5) to mount the base 32 to wall 68 before key lock 56 is mounted thereto.

Key lock 56 includes a stationary barrel 60 with a tumbler cylinder 72 mounted therein for rotation between locked and unlocked positions. Barrel 60 has an apertured flange 54 at the rearward end thereof to facilitate mounting, and a collar or cap 74 having a rim 76 to center the lock in an aperture 78 through interior wall 68 and aperture 79 through exterior wall 80. The cap 74 is inserted through aperture 79 from the exterior side of wall 80 and over the forward end of tumbler 72 which projects outwardly to exterior wall 80. Cap 74 includes a key hole opening 82 through which a key 84 is inserted into tumbler 72 to operate the lock 56. A drive shaft 86 extends from the rear of barrel 60 and is connected with tumbler cylinder 72 and rotates therewith.

Key lock 56 is of conventional construction and includes a plurality of tumblers (not shown) mounted in cylinder 72, and means for positively limiting rotation of cylinder 72 at the locked and unlocked positions. A key lock having a tumbler cylinder which rotates through a conventional angle between the locked and unlocked position, such as 90 or 180 degrees, can be used. However, an advantage of the locking mechanism of the invention is that it smoothly and easily transfers a small angular motion, through a relatively short radius, to the desired linear motion of lock rods 34, 35 which is needed to securely lock a closure member of an office furniture unit such as a swinging door on a cabinet. Accordingly, a key lock having a 90 degree rotation of the tumbler cylinder between the locked and unlocked positions is both adequate and desirable because it, in combination with the other components of the locking mechanism 12, smoothly facilitates the desired linear motion of lock rods 34, 35 with just a quarter turn (90 degrees) of the key 84.

An actuator disc 88 is fixedly secured to drive shaft 86 of tumbler cylinder 72 by means of a fastener 90 passing through a central aperture 92 of actuator disc 88, so that rotation of key 84, when inserted into tumbler cylinder 72, causes cylinder 72, drive shaft 86, and actuator disc 88 to rotate together. In the illustrated embodiment, the drive shaft includes a square lug 94 which is received within a square aperture 92 at a central recessed area 96 with a washer and the head of fastener 90 engaging the surfaces of the recessed area surrounding the aperture 92.

Figure 7:
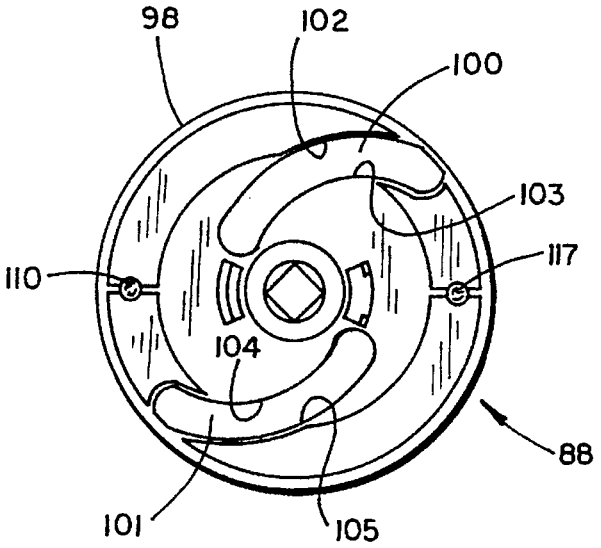
FIG. 7 is an elevational view of the actuator for the locking mechanism from the side thereof facing toward the base of the locking mechanism.
Figure 8:
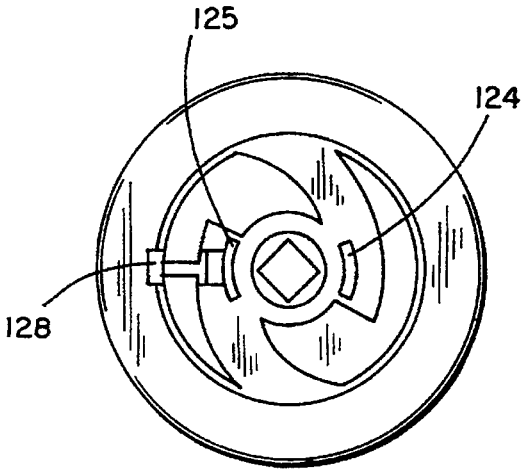
FIG. 8 is an elevational view of the actuator for the locking mechanism from the side thereof facing away from the base of the locking mechanism.

The actuator disc 88 (FIGS. 7 and 8) is generally cylindrical in shape and has a curved circumferential wall 98 which underlies a portion of the perimeter wall 46 of base 32 when the lock mechanism 12 is fully assembled. The actuator disc 88 includes a pair of arcuate channels 100, 101 on the side which face toward the base 32. Arcuate channels 100, 101 include oppositely facing camming surfaces 102, 103 and 104, 105, respectively. The arcuate channels 100, 101 and camming surfaces 102, 103, 104, 105 trace a pathway which substantially coincides with a quarter circumference of a circle, with one end of channels 100, 101 being radially disposed from the axis of rotation of cylinder 72 by a distance about equal to the distance between the cylinder axis and respective projections 36, 37 when in the unlocked position, and with the other end being radially disposed from the cylinder axis by a distance about equal to the distance between the cylinder axis and projections 36, 37 when in the locked position. The arcuate channels continuously diverge radially outwardly from one end thereof to the other end. The camming surfaces 102, 103 are uniformly spaced apart by a distance substantially equal to or slightly greater than the diameter of the projection 36 on rod 34, so that camming surfaces 102, 103 engage projection 36 causing it to move within guide channel 38, and rod 34 to move linearly along its main longitudinal axis when actuator 88 is rotated by turning key 84. More specifically, when actuator 88 is rotated in a counterclockwise direction (with respect to the view in FIGS. 3 and 4) from the locked position (FIG. 3) camming surface 102 bears upon an upper surface of projection 36 causing it to move downwardly within guide channel 38 and causing lock rod 34 to move downwardly, with the distal end 106 thereof being withdrawn from an aperture 107 in the top panel 20 of cabinet 10 (FIG. 1), in which distal end 106 is normally received when in the locked position. Counterclockwise rotation (with respect to the view in FIG. 3) of actuator 88 is continued through a 90° angle (quarter turn) until the lock rod 34 is fully retracted to the unlocked position shown in FIG. 4. To relock the cabinet or other furniture unit, key 84 is rotated so that actuator 88 rotates in a clockwise direction (with respect to the view of FIGS. 3 and 4) causing camming surface 103 to bear upon the underside of projection 36, causing projection 36 and lock rod 34 to move upwardly so that distal end 106 thereof is received within aperture 107 when locking mechanism 12 reassumes the locked position shown in FIG. 3. Similarly, camming surfaces 104, 105 are uniformly spaced apart by a distance substantially equal to or slightly greater than the diameter of projection 37 or rod 35, so that camming surface 104, 105 will engage projection 37 causing it to move within guide channel 39, and causing rod 35 to move linearly along its main longitudinal axis when actuator 88 is rotated. When actuator 88 is rotated in a counterclockwise direction (with respect to the view in FIGS. 3 and 4) from the locked position (FIG. 3) camming surface 105 bears upon the underside of projection 37 causing it to move upwardly within guide channel 39 and causing lock rod 35 to move upward, with the distal end 108 being withdrawn from an aperture 109 in base 16 of cabinet 10 (FIG. 1), in which distal end 108 is normally received when in the locked position. Counterclockwise rotation (with respect to the view in FIG. 3) of actuator 88 is continued through a 90° angle (quarter turn) until the lock rod 35 is fully retracted to the unlocked position shown in FIG. 4. Relocking involves clockwise rotation (with respect to the view in FIG. 3) of the actuator which causes camming surface 104 to bear upon the upper side of projection 37, causing projection 37 and lock rod 35 to move downwardly and reassume the locked position shown in FIG. 3.

Figure 4:
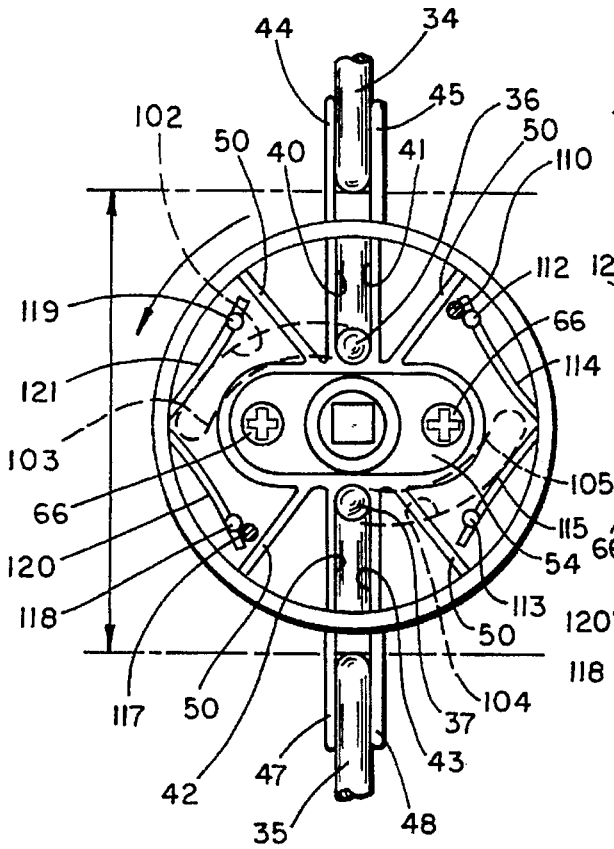
FIG. 4 is a fragmentary, elevational view of the locking mechanism facing the side thereof which is to be mounted to an interior surface of a furniture unit, showing the lock rods in the retracted or unlocked position.
Figure 3:
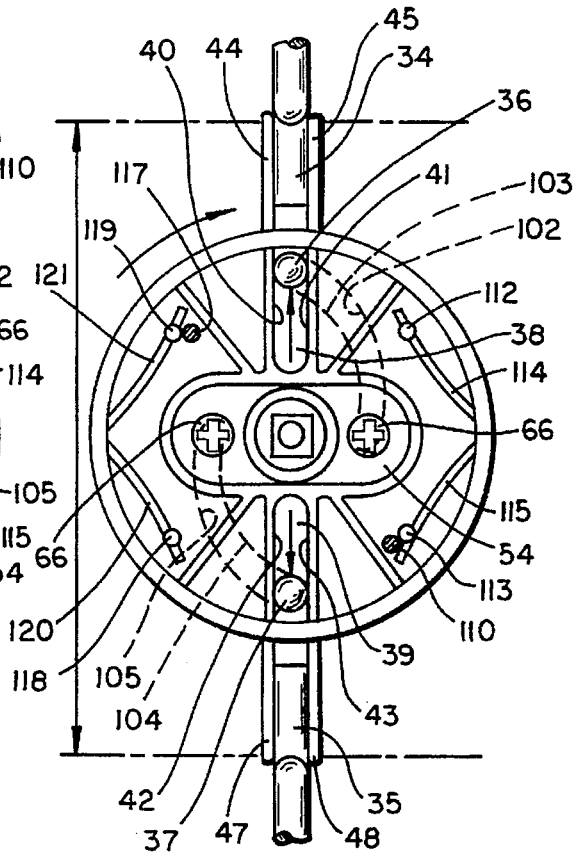
FIG. 3 is a fragmentary, elevational view of the locking mechanism facing the side thereof which is to be mounted to an interior surface of a furniture unit, showing the lock rods in the extended or locked position.

The actuator 88 is preferably made of a thermoplastic material, such as polypropylene, and is suitably formed such as by injection molding. The actuator 88 is preferably formed with integral pin 110 which projects outwardly from the side of the actuator facing base 32 and engages cylindrical stop projections 112 and 113 on cantilever springs 114, 115, respectively, when actuator 88 is fully rotated to the open position (FIG. 4) and closed position (FIG. 3), respectively. Similarly, actuator 88 preferably includes integral pin 117 which projects outwardly toward the base 32 and engages stops 118, 119 on springs 120, 121, respectively, when actuator 88 is fully rotated to the open position (FIG. 4) and closed position (FIG. 3), respectively. More specifically, springs 114, 115, 120, and 121 are resiliently biased away from the circumferential wall 46 toward the rotational axis of the tumbler cylinder 72 so that pins 110 and 117 are engaged by one of the springs as the actuator 88 is rotated into a position at or near to the fully unlocked or fully locked positions. In order to reach the fully locked position (FIG. 3), pin 110 must pass over stop 113 and become wedged against the juncture between stop 113 and the unsupported or distal end of cantilever spring 115, as shown in FIG. 3. Likewise, pin 117 becomes wedged against the juncture between stop 119 and the distal end of cantilever spring 121. The force applied by springs 115 and 121 onto pins 110 and 117 is sufficient to retain the actuator and, hence, tumbler cylinder 72 precisely in the locked position so that vibrations or other incidental influences do not cause the cylinder to rotate slightly, which sometimes makes it difficult to insert the key 84 into the key lock 56. Springs 114, 120 and stops 112, 118 cooperate with pins 110, 117 in a similar manner to maintain the lock in an unlocked position, as shown in FIG. 4. The internal stops of the key lock 56, in combination with the springs 114, 115, 120, 121, and stops 118, 119 of base 32, and the pins 110, 117 of actuator 88, coact to maintain the lock in precise unlocked and locked positions so that any play or looseness in the positioning of the cylinder 72 in barrel 60 can be controlled, thereby ensuring easy insertion and removal of the key 84 from cylinder 72. While the force applied by springs 114, 115, 120, and 121 is sufficient to prevent normal vibrations and other incidental influences from causing the cylinder 72 to shift from its precise locked or unlocked position, such force is easily overcome by inserting key 84 into cylinder 72 and rotating the same.

Actuator 88 also includes a pair of slots 124, 125 which receive resiliently biased tabs (not shown) on a cover plate 126. A notch 128 is provided at the mating juncture between actuator 88 and cover plate 126 for insertion of a tool which can press against the resilient tab inserted in slot 125 to disengage the same and allow easy removal of the plate 126.

Lock rods 34, 35 can be offset away from the interior wall 68 as shown in FIGS. 2 and 3 to allow adequate clearance between the interior wall and the rods 34, 35. More specifically, it is frequently desirable to form two 90 degree bends 128, 129 (FIG. 5) in rods 34, 35 near the proximal ends thereof adjacent base 32 and actuator 88 so that the major portion of rods 34, 35 extending from base 32 and actuator 88 to the respective apertures 107, 109 is spaced away from wall 68 to minimize frictional resistance and jamming. It may also be desirable to provide an additional offset at the distal ends of rods 34, 35 so that apertures 107, 109 can be positioned sufficiently inwardly of the forward edges of the top 20 and base 16, respectively, of cabinet 10. Additional guide brackets 130 can be utilized to help support and guide rods 34, 35 for linear reciprocating motion.

It will be understood by those who practice the invention and by those skilled in the art, that various modifications and improvements may be made to the invention without departing from the spirit of the disclosed concept. The scope of protection afforded is to be determined by the claims and by the breadth of interpretation allowed by law.

The embodiments of the invention in which an exclusive property or privilege is claimed are defined as follows:

1. A locking mechanism for a furniture unit, comprising:

a base adapted to be mounted onto an interior side of a door of a furniture unit, said base including a pair of integral linear guide channels, each guide channel being at least partially defined by spaced sidewalls;

a lock rod received in each of said linear guide channels, each of said lock rods having a radially extending projection engaging said spaced sidewalls;

a key lock having a stationary barrel fixedly attached to said base, and a lock tumbler cylinder mounted within said stationary barrel for rotation between a locked position and an unlocked position; and an actuator fixedly attached to a drive shaft connected to said tumbler cylinder, said actuator including a pair of arcuate channels, each of said arcuate channels being at least partially defined by spaced camming surfaces which engage opposing sides of one of said projections of said lock rods, whereby rotation of said actuator urges said rods toward a rotational axis of said tumbler cylinder and counter-rotation of said actuator urges said rods away from the rotational axis of said tumbler cylinder, and said base further comprising cantilever springs having a stop element disposed thereon, and said actuator further comprising at least one projection which is engaged by one of said springs and by said stop element disposed thereon to maintain the lock in an unlocked or locked position when the tumbler is fully rotated to said unlocked or locked position.

2. The locking mechanism of claim 1, wherein said linear guide channels are longitudinally aligned.

3. The locking mechanism of claim 2, wherein said camming surfaces are uniformly spaced apart by a distance substantially equal to or slightly greater than the diameter of said projection of said lock rod.

4. The locking mechanism of claim 3, wherein said camming surfaces continuously diverge away from a rotational axis of said lock tumbler cylinder.

5. The locking mechanism of claim 4, further comprising spaced, parallel guide walls which extend radially outwardly from said base and which help guide said lock rods for linear movement between locked and unlocked positions.

6. The locking mechanism of claim 5, wherein said base further comprises cantilever springs having a stop element disposed thereon, and said actuator further comprises at least one projection which is engaged by one of said springs and by said stop element disposed thereon to maintain the lock in an unlocked or locked position when the tumbler is fully rotated to said unlocked or locked position.

7. The locking mechanism of claim 6, wherein said camming surfaces trace a pathway which substantially coincides with a quarter circumference of a circle.

8. A lockable furniture unit, comprising:

a plurality of stationary wall panels and at least one closure member which together define a substantially continuous storage enclosure; and a locking mechanism, said locking mechanism including a base mounted onto an interior side of said at least one closure member of the furniture unit, said base including a pair of integral linear guide channels, each guide channel being at least partially defined by spaced sidewalls; a lock rod received in each of said linear guide channels, each of said lock rods having a radially extending projecting engaging said spaced sidewalls; a key lock having a stationary barrel fixedly attached to said base, and a lock tumbler cylinder mounted within said stationary barrel for rotation between a locked position and an unlocked position; and an actuator fixedly attached to a drive shaft connected to said tumbler cylinder, said actuator including a pair of arcuate channels, each of which is at least partially defined by spaced camming surfaces which engage opposing sides of one of said projections of lock rods, whereby rotation of said actuator urges said rods toward a rotational axis of said tumbler cylinder and counter-rotation of said actuator urges said rods away from the rotational axis of said tumbler cylinder, and said base further comprising cantilever springs having a stop element disposed thereon, and said actuator further comprising at least one projection which is engaged by one of said springs and by said stop element disposed thereon to maintain the lock in an unlocked or locked position when the tumbler is fully rotated to said unlocked or locked position.

9. The lockable furniture unit of claim 8, wherein said linear guide channels are longitudinally aligned.

10. The lockable furniture unit of claim 9, wherein said camming surfaces are uniformly spaced apart by a distance substantially equal to or slightly greater than the diameter of said projection of said lock rod.

11. The lockable furniture unit of claim 10, wherein said camming surfaces continuously diverge away from a rotational axis of said lock tumbler cylinder.

12. The lockable furniture unit of claim 11, further comprising spaced, parallel guide walls which extend radially outwardly from said base and which help guide said lock rods for linear movement between locked and unlocked positions.

13. The lockable furniture unit of claim 12, wherein said base further comprises cantilever springs having a stop element disposed thereon, and said actuator further comprises at least one projection which is engaged by one of said springs and by said stop element disposed thereon to maintain the lock in an unlocked or locked position when the tumbler is fully rotated to said unlocked or locked position.

14. The lockable furniture unit of claim 13, wherein said camming surfaces trace a pathway which substantially coincides with a quarter circumference of a circle.

15. A furniture locking mechanism for deploying and retracting opposing reciprocating lock bars between locked and unlocked positions, comprising:

a base adapted to be mounted onto an interior side of a door of a furniture unit, said base including a pair of integral linear guide channels, each guide channel having spaced sidewalls adapted to receive a lock rod and to engage a radial projection of the lock rod;

a key lock having a stationary barrel fixedly attached to said base, and a lock tumbler cylinder mounted within said stationary barrel for rotation between a locked position and an unlocked position;

an actuator fixedly attached to a drive shaft connected to said tumbler cylinder, said actuator including a pair of arcuate channels, each of said arcuate channels being at least partially defined by spaced camming surfaces which engage opposing sides of one of said projections of said lock rods, whereby rotation of said actuator urges said rods toward a rotational axis of said tumbler cylinder and counter-rotation of said actuator urges said rods away from the rotational axis of said tumbler cylinder, and said base further comprising catilever springs having a stop element disposed thereon, and said actuator further comprising at least one projection which is engaged by one of said springs and by said stop element disposed thereon to maintain the lock in an unlocked or locked position when the tumbler is fully rotated to said unlocked or locked position.

16. The locking mechanism of claim 15, wherein said linear guide channels are longitudinally aligned.

17. The locking mechanism of claim 16, wherein said camming surfaces are uniformly spaced apart by a distance substantially equal to or slightly greater than the diameter of said projection of said lock rod.

18. The locking mechanism of claim 17, wherein said camming surfaces continuously diverge away from a rotational axis of said lock tumbler cylinder.

19. The locking mechanism of claim 18, further comprising spaced, parallel guide walls which extend radially outwardly from said base and which help guide said lock rods for linear movement between locked and unlocked positions.

* * * * *